US005905970A

United States Patent [19]

Aoyagi

[11] Patent Number: 5,905,970

[45] Date of Patent: May 18, 1999

[54] SPEECH CODING DEVICE FOR ESTIMATING AN ERROR OF POWER ENVELOPES OF SYNTHETIC AND INPUT SPEECH SIGNALS

[75] Inventor: Hiromi Aoyagi, Tokyo, Japan

[73] Assignee: Oki Electric Industry Co., Ltd., Tokyo, Japan

[21] Appl. No.: 08/763,439

[22] Filed: Dec. 11, 1996

[30] Foreign Application Priority Data

Dec. 18, 1995 [JP] Japan ..... 7-328505

[51] Int. Cl.[6] ..... G10L 9/00

[52] U.S. Cl. ..... 704/220; 704/211; 704/261; 704/264

[58] Field of Search ..... 704/211, 261, 704/220, 264

[56] References Cited

U.S. PATENT DOCUMENTS

| | | | |
|---|---|---|---|
| 5,396,576 | 3/1995 | Miki | 704/222 |
| 5,602,959 | 2/1997 | Bergstrom | 704/205 |
| 5,659,658 | 8/1997 | Vanska | 704/261 |

FOREIGN PATENT DOCUMENTS

| | | |
|---|---|---|
| 0 654 909 | 5/1995 | European Pat. Off. . |
| 5-73099 | 3/1993 | Japan . |
| 6-130995 | 5/1994 | Japan . |
| 6-130996 | 5/1994 | Japan . |
| 6-130998 | 5/1994 | Japan . |
| 7-134600 | 5/1995 | Japan . |

OTHER PUBLICATIONS

Thomas Parsons "voice and speech processing" pp. 191–200, 1986.

Atal, B.S. "High–Quality Speech at Low Bit Rates: Multi–Pulse and Stochastically Excited Linear Predictive Coders". ICASSP 86 Proceedings. IEEE–IECEJ–ASJ International Conference on Acoustics, Speech and Signal Processing (Cat. No. 86CH2243–4), Tokyo Japan, Apr. 7–11, 1986. IEEE, New York, NY, USA pp. 1681–1684 vol. 3, XP002071240.

"High–Quality Speech at Low Bit Rates: Multi–Pulse and Stochastically Excited Linear Predictive Coders", B.S. Atal, Proc. ICASSP, 1986, pp. 1681–1684.

*Primary Examiner*—David R. Hudspeth
*Assistant Examiner*—Daniel Abebe
*Attorney, Agent, or Firm*—Rabin & Champagne, P.C.

[57] ABSTRACT

In a speech coding device for coding an input speech with an AbS (Analysis by Synthesis) system and one of a forward type and a backward type configuration, a vocal tract prediction coefficient generating circuit produces a vocal tract prediction coefficient from one of an input speech signal and a locally reproduced synthetic speech signal. A speech synthesizing circuit produces a synthetic speech signal by using codes stored in an excitation codebook in one-to-one correspondence with indexes, and the vocal tract prediction coefficient. A comparing circuit compares the synthetic speech signal and input speech signal to thereby output an error signal. A perceptual weighting circuit weights the error signal to thereby output a perceptually weighted signal. A codebook index selecting circuit selects an optimal index for the excitation codebook out of at least the weighted signal, and feeds the optimal index to the excitation codebook. A power envelope estimating circuit produces power envelope signals from the synthetic speech signal and input speech signal, and compares the power envelope signals to thereby estimate an error signal representative of a difference between the envelope signals. The codebook index selecting circuit selects the optimal index on the basis of the error signal and weighted signal. The device is capable of reproducing a synthetic speech faithfully matching an input original speed signal without deteriorating perceptual naturalness.

4 Claims, 4 Drawing Sheets

SPEECH CODING DEVICE FOR ESTIMATING AN ERROR OF POWER ENVELOPES OF SYNTHETIC AND INPUT SPEECH SIGNALS

BACKGROUND OF THE INVENTION

1. Field of the Invention

The present invention relates to a speech coding device advantageously applicable to a CELP (Code Excited Linear Prediction) coding system or an MPE (Multi-Pulse Excitation) linear prediction coding system.

2. Description of the Background Art

Today, an AbS (Analysis by Synthesis) system, e.g., a CELP coding system or an MPE linear prediction coding system is available for the low bit rate coding and decoding of speeches and predominant over the other systems. Generally, the problem with models for the study of speeches is that it is difficult, with many of them, to determine the value of a parameter for a given input speech by an analytical approach. The AbS system is one of solutions to such a problem and causes the parameter to vary in a certain range, actually synthesize speeches, and then selects one of the synthetic speeches having the smallest distance to an input speech. This kind of coding and decoding scheme is taught in, e.g., B. S. Atal "HIGH-QUALITY SPEECH AT LOW BIT RATES: MULTI-PULSE AND STOCHASTICALLY EXCITED LINEAR PREDICTIVE CODERS", Proc. ICASSP, pp. 1681–1684, 1986.

Briefly, the AbS system synthesizes speech signals in response to an input speech signal, and generates error signals representative of the differences between the synthetic speech signals and the input speech signal. Subsequently, the system computes square sums of the error signals, and then selects one of the synthetic speech signals having the smallest square sum. For the synthetic speech signals, a plurality of excitation signals prepared beforehand are used. For the excitation, the CELP system and MPE system use random Gaussian noise and a pulse sequence, respectively.

The problem with the AbS system is that the square sums of the error signals used for the evaluation of the excitation signals cannot render the synthetic speech signal sufficiently natural alone in the human auditory perception aspect. For example, an unnatural waveform absent in the original speech signal is apt to appear in the synthetic speech signal. Under these circumstances, there is an increasing demand for a speech coding device capable of producing, without deteriorating perceptual naturalness, a synthetic speech signal faithfully representing an input speech signal.

SUMMARY OF THE INVENTION

It is therefore an object of the present invention to provide a speech coding device capable of producing a synthetic speech signal faithfully representing an input speech signal without deteriorating perceptual naturalness.

In accordance with the present invention, a speech coding device for coding an input speech with an AbS system and one of a forward type and a backward type configuration includes a vocal tract prediction coefficient generating circuit for producing a vocal tract prediction coefficient from one of an input speech signal and a locally reproduced synthetic speech signal. A speech synthesizing circuit produces a synthetic speech signal by using codes stored in an excitation codebook in one-to-one correspondence with indexes, and the vocal tract prediction coefficient. A comparing circuit compares the synthetic speech signal and input speech signal to thereby output an error signal. A perceptual weighting circuit perceptually weights the error signal to thereby output a perceptually weighted signal. A codebook index selecting circuit selects an optimal index for the excitation codebook out of at least the perceptually weighted signal, and feeds the optimal index to the excitation codebook. A power envelope estimating circuit produces a first power envelope signal from the synthetic speech signal, produces a second power envelope signal from the input speech signal, and compares the first and second power envelope signals to thereby estimate an error signal representative of a difference between the first and second envelope signals. The codebook index selecting circuit selects the optimal index on the basis of the error signal and perceptually weighted signal.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 1:
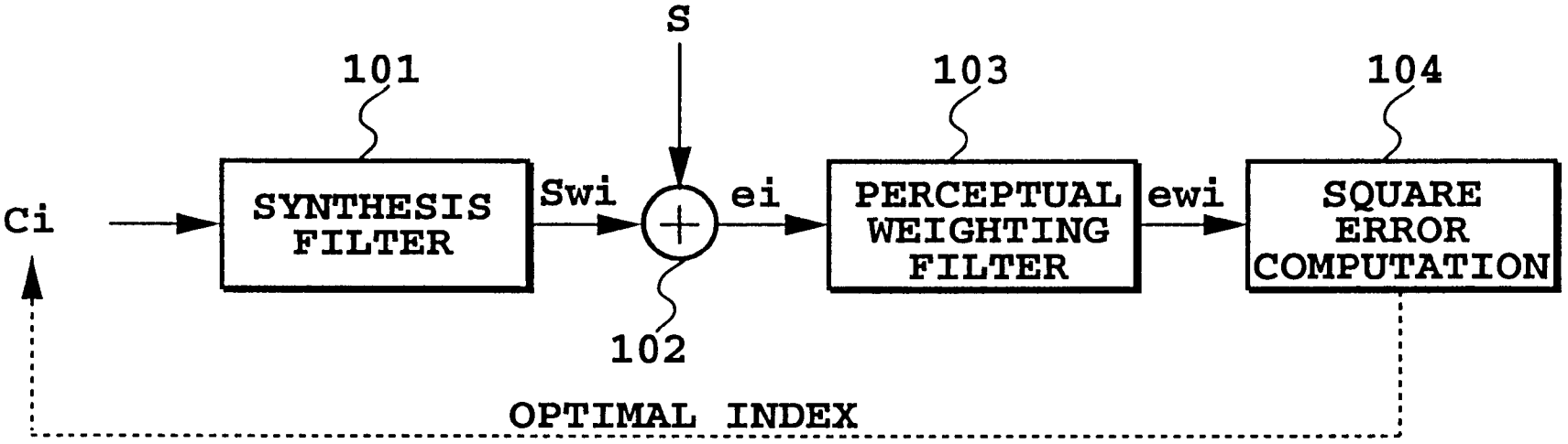
FIG. 1 PRIOR ART
FIG. 1 is a block diagram schematically showing a conventional AbS system.

To better understand the present invention, a brief reference will be made to a conventional AbS system, shown in FIG. 1. As shown, the AbS system includes a synthesis filter 101, a subtracter 102, a perceptual weighting filter 103, and a square sum computation 104. The synthesis filter 101 processes a plurality of excitation signals Ci (i=1 through N) prepared beforehand and outputs synthetic speech signals Swi. The subtracter 102 computes differences between an input speech signal S and the synthetic speech signals Swi and outputs the resulting error signals ei. The perceptual weighting filter 103 perceptually weights each of t he error signals ei so as to produce a corresponding weighted error signal ewi. The square sum computation 104 produces the square sums of the weighted error signals ewi. As a result, the synthetic speech signal Swi having the smallest distance to the input speech signal S is selected. This conventional AbS scheme, however, has the previously discussed problem left unsolved.

Figure 3:
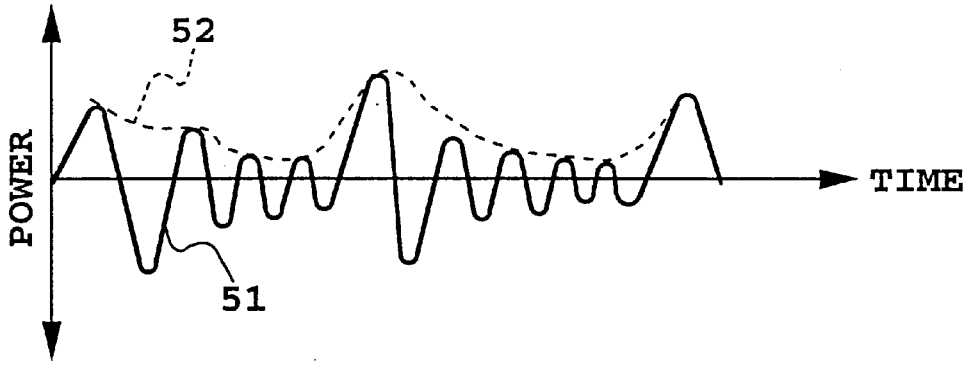
FIG. 3 shows a specific envelope which the embodiment of FIG. 2 uses for evaluation.

Preferred embodiments of the speech coding device in accordance with the present invention will be described hereinafter. Briefly, for the selection an optimal excitation signal, the embodiments use not only the square sums of waveform error signals but also the envelope information of speech signal waveforms. FIG. 3 shows a specific curve 51 representative of the power of a speech signal, and a specific power envelope 52 enveloping the curve 51.

Specifically, the embodiments pertain to an analytic speech coding system which produces error signals representative of differences between an input speech signal and synthetic speech signals, perceptually weights them, outputs the square sums of the weighted error signals, and then selects one excitation signal having the smallest distance to the input speech signal, i.e., the smallest waveform error evaluation value. In each embodiment, an envelope signal is produced with each of the input speech signal and synthetic speech signals. The envelope signals are compared in order to compute envelope error evaluation values. These values are used for the selection of the optimal excitation signal in addition to the waveform error evaluation values.

Figure 2:
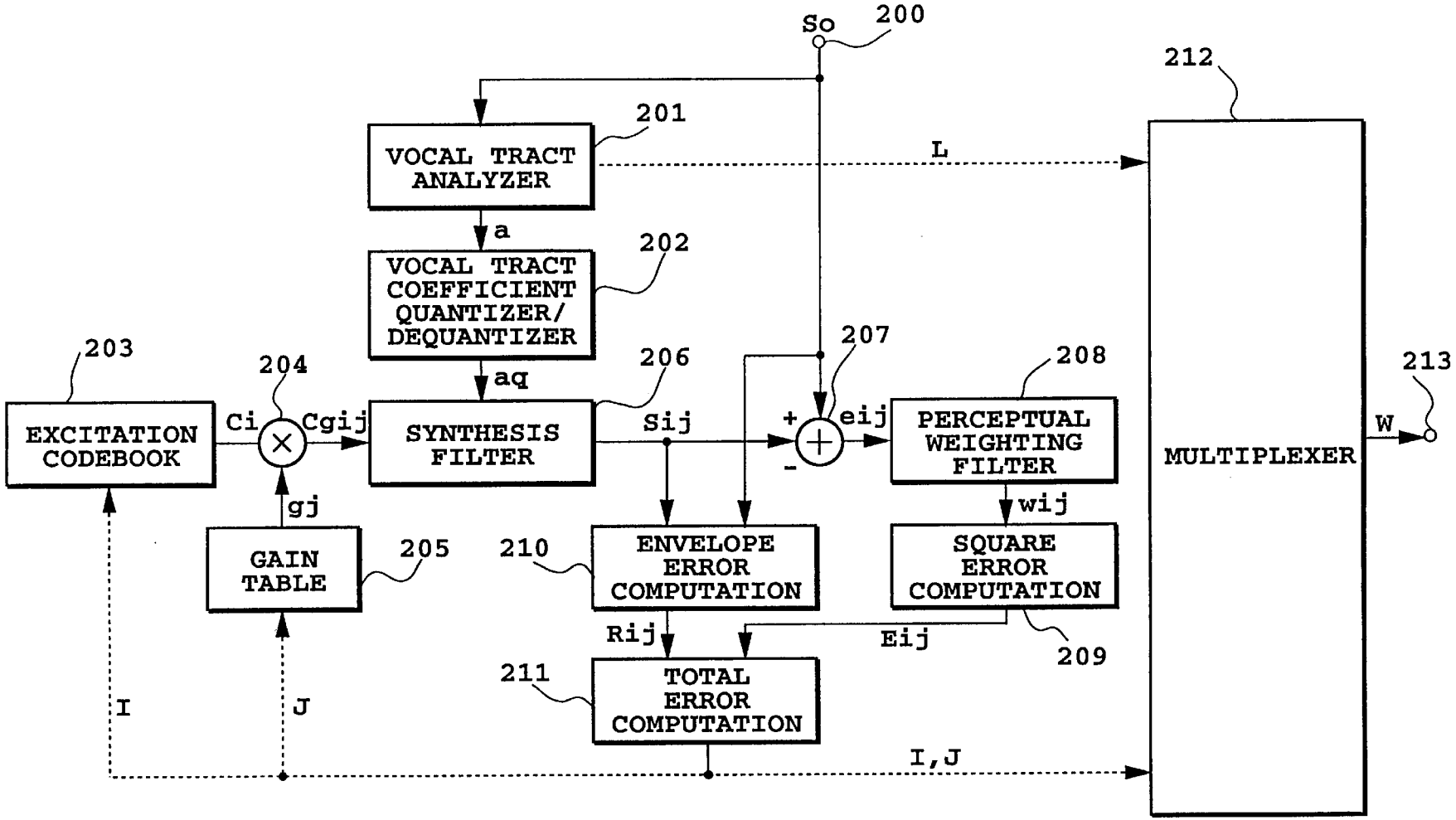
FIG. 2 is a block diagram schematically showing a speech coding device embodying the present invention and using the CELP system.

Referring to FIG. 2, a speech coding device embodying the present invention is shown and has a CELP type configuration. As shown, the device has a vocal tract analyzer 201, a vocal tract prediction coefficient quantizer/dequantizer 202, an excitation codebook 203, a multiplier 204, a gain table 205, a synthesis filter 206, a subtracter 207, a perceptual weighting filter 208, a square error computation 209, an envelope error computation 210, a total error computation 211, and a multiplexer 212. An original speech vector signal So is input to the device via an input terminal 200 as a frame-by-frame vector signal. Coded speech data are output via an output terminal 213 as a total code signal W.

The vocal tract analyzer 201 receives the original speech vector signal So and determines a vocal tract prediction coefficient or LPC (Linear Prediction Coding) coefficient a frame by frame. The LPC coefficient is fed from the analyzer 201 to the vocal tract prediction quantizer/dequantizer 202. The quantizer/dequantizer 202 quantizes the input LSP coefficient a, generates a vocal tract prediction coefficient index L corresponding to the quantized value, and feeds the index L to the multiplexer 212. At the same time, the quantizer/dequantizer 202 produces a dequantized value aq and delivers it to the synthesis filter 206.

The excitation codebook 203 receives an index I from the total error computation 211. In response, the codebook 203 reads out an excitation vector Ci (i=1 through N; N being a natural number) corresponding to the index I, and feeds it to the multiplier 204. The gain table 205 delivers gain information gj (j=1 through M; M being a natural number) to the multiplier 204. Specifically, the gain table 205 receives an index j from the total error computation 211 and reads out gain information gj corresponding to the index j. The multiplier 204 multiplies the excitation vector Ci by the gain information gj and outputs the resulting product vector signal Cgij. The product vector signal Cgij is fed to the synthesis filter 206.

The synthesis filter 206 is implemented as, e.g., a cyclic digital filter and receives the dequantized value aq (meaning the LPC coefficient) output from the quantizer/dequantizer 202 and the product vector signal Cgij output from the multiplier 204. The filter 206 outputs a synthetic speech vector Sij based on the value aq and signal Cgij and delivers it to the subtracter 207 and envelope error computation 210. The subtracter 207 produces a difference eij between the original speech vector signal So input via the input terminal 200 and the synthetic speech vector Sij. The difference vector signal eij is applied to the perceptual weighting filter 208.

The perceptual weighting filter 208 weights the difference vector signal eij with respect to frequency. Stated another way, the weighting filter 208 weights the difference vector signal eij in accordance with the human auditory perception characteristic. A weighted signal wij output from the weighting filter 208 is fed to the square error computation 209. Generally, as for the speech formant or the pitch harmonics, quantization noise lying in the frequency range of great power sounds low to the ear due to the auditory masking effect. Conversely, quantization noise lying in the frequency of small power sounds as it is without being masked. The above terms "perceptual weighting" therefore refer to frequency weighting which enhances quantization noise lying in the frequency range of great power while suppressing quantization noise lying in the frequency range of small power.

More specifically, the human auditory sense has a so-called masking characteristic; if a certain frequency component is loud, frequencies around it are difficult to hear. Therefore, the difference between the original speech and the synthetic speech with respect to human auditory perception, i.e., how much a synthetic speech sounds distorted does not always correspond to the Euclid distance. This is why the difference between the original speech and the synthetic speech is passed through the perceptual weighting filter 208. The resulting output of the weighting filter 208 is used as a distance scale. The weighting filter 208 reduces the distortion of loud portions on the frequency axis while increasing that of low portions.

The square error computation 209 produces a square sum Eij with the individual component of the weighted vector signal wij. The square sum is delivered to the total error computation 211.

The envelope error computation 210 produces an envelope vector Vo for the original speech vector signal So, and an envelope vector Vij for the synthetic speech vector Sij received from the synthesis filter 206. A specific envelope is shown in FIG. 3, as stated earlier. The envelope vectors Vo and Vij can be produced if the absolute values of the components of the original speech vector signal So and synthetic speech vector signal Sij are processed by a digital low-pass filter. The digital low-pass filter may be represented by a transfer function formula:

$$(1-b)/(1-b\cdot Z^{-1})\quad 0<b<1 \tag{1}$$

Figure 4:
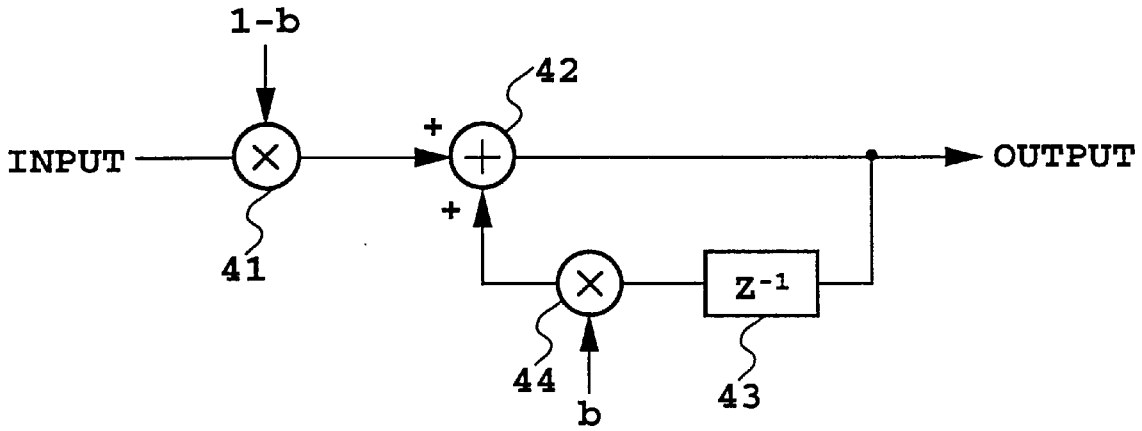
FIG. 4 is a circuit diagram showing a specific configuration of a low-pass filter implementing an envelope error computing circuit included in the embodiment.

FIG. 4 shows a specific configuration of the above digital low-pass filter. As shown, the filter is made up of a multiplier 41, an adder 42, a delay circuit ($Z^{-1}$) 43 and a multiplier 44 which are connected together, as illustrated. The multiplier 41 multiplies the input signal by a coefficient (1−b) included in the above formula (1) and feeds the resulting product to the adder 42. The adder 42 adds the product and an output of the multiplier 44 and delivers the resulting sum to the delay 43. The delay 43 delays the output of the adder 42 and feeds its output to the multiplier 44. The multiplier 44 multiplies the output of the delay circuit 43 by a coefficient b.

Referring again to FIG. 2, the envelope error computation 210 produces a vector signal representative of a difference between the envelope vectors Vo and Vij. Then, the computation 210 determines a square sum vector signal Rij with the individual component of such a difference vector signal, and feeds it to the total error computation 211. With this envelope error computation, the embodiment can bring the synthetic speech vector signal Sij close to the original speech vector signal So with fidelity.

The total error computation 211 outputs a total error vector signal Tij on the basis of the square sum vector signal Eij output from the square error computation 209 and the square sum vector signal Rij output from the envelope error computation 210. The total error vector signal Tij should preferably be determined by a method represented by a formula:

$$Tij=d\cdot Eij+(1-d)\cdot Rij \quad 0<d<1 \qquad (2)$$

To allow the square sum vector signal Eij to effect the total error vector signal Tij more than the square sum vector signal Rij, it is preferable to increase the value d. Conversely, to provide the signal Rij with ascendancy over the signal Eij as to the above effect, it is preferable to reduce the value d.

Further, the total error computation 211 searches for an i and j combination minimizing the total error vector signal Tij, and outputs the determined i and j as optimal indexes I and J, respectively. The optimal indexes I and J are fed to the excitation codebook 203 and gain table 205, respectively. At the same time, the optimal indexes I and J are applied to the multiplexer 212. With the optimal indexes I and J, it is possible to bring the power variation of the synthetic speech vector signal Sij close to that of the original speech vector signal So.

The multiplexer 212 multiplexes the vocal tract prediction coefficient index L output from the quantizer/dequantizer 202 and the optimal indexes I and J output from the total error computation 211 to thereby output a total code signal W. The total code signal W is sent from the speech coding device to a speech decoding device, not shown, via the output terminal 213.

The operation of the illustrative embodiment will be described specifically hereinafter. The vocal tract analyzer 201 produces a vocal tract prediction coefficient (LPC coefficients) a from an input original speech vector signal So. The vocal tract prediction coefficient quantizer/dequantizer 202 quantizes the prediction coefficient a and generates a corresponding prediction coefficient index L. The index L is applied to the multiplexer 212. At the same time, quantizer/dequantizer 202 outputs a dequantized value aq associated with the quantized value. The dequantized value aq is fed to the synthesis filter 206.

The excitation codebook 203 initially reads out any one of the excitation vectors Ci. Likewise, the gain table 205 initially reads out any one of the gain information gj. The multiplier 204 multiplies the excitation vector Ci and gain information gj and feeds the resulting product vector signal Cgij to the synthesis filter 206. The synthesis filter 206 digitally filters the product vector signal Cgij and dequantized value aq and thereby outputs a synthetic speech vector signal Sij. The subtracter 207 produces a difference between the synthetic speech vector signal Sij and the original speech vector signal So, i.e., a difference vector signal eij. The perceptual weighting filter 208 weights the difference vector signal eij in accordance with the human auditory perception characteristic and feeds the resulting perceptually weighted vector signal wij to the square error computation 209. In response, the computation 209 outputs a square sum vector signal Eij with the individual component of the vector signal wij and applies it to the total error computation 211.

On the other hand, the envelope error computation 210 produces the absolute values of the components of the envelope vector Vo and synthetic speech vector Sij. With the digital low-pass filter represented by the formula (1), the computation 210 determines an envelope vector Vij. Then, the computation 210 produces a difference vector signal representative of a difference between the two envelope vectors Vo and Vij. Further, the computation 210 determines a square sum vector signal Rij with each component of the difference vector signal. This signal Rij and the square sum vector signal Eij output from the square error computation 209 are fed to the total error computation 211.

The total error computation 211 produces a total error vector signal Tij on the basis of the vector signals Rij and Eij and by use of the formula (2). Subsequently, the computation 211 determines an i and j combination minimizing the vector signal Tij, and outputs the determined values i and j as optimal indexes I and J. The optimal indexes I and J are applied to the excitation codebook 203 and gain table 205, respectively. Also, the optical indexes I and J are applied to the multiplexer 212.

The excitation codebook 203 reads out an excitation vector Ci whose index matches the optimal index I, and again delivers it to the multiplier 204. Likewise, the gain table 205 reads out gain information gj whose index matches the optimal index J, and again delivers it to the multiplier 204. The multiplexer 212 multiplexes the optimal indexes I and J and vocal tract prediction coefficient index L and outputs a total code signal W. The total code signal W is output via the output terminal 213.

As stated above, with the CELP type configuration, the illustrative embodiment uses envelope information in addition to square sum information at the time of selection of an optimal excitation signal. This allows a synthetic speech signal to be generated without losing perceptual naturalness.

Specifically, in the above embodiment, the power envelope signal of a synthetic speech signal and that of an input original speech signal are compared to produce their difference or error. A n optimal index is selected on the basis of a signal representative of the above error and a perceptually weighted signal. A code read out of a codebook is optimally corrected by the optimal index signal. The resulting power envelope of the synthetic speech signal is extremely close to the power envelope of the original speech signal. Moreover, because the envelopes are brought into coincidence, even the auditory perception can be matched to the original speech. Therefore, codes and index information capable of matching original speech signals to an utmost degree are achievable. A speech decoding device, receiving such information and vocal tract prediction coefficients, is capable of reproducing speeches far more faithfully than conventional.

Figure 5:
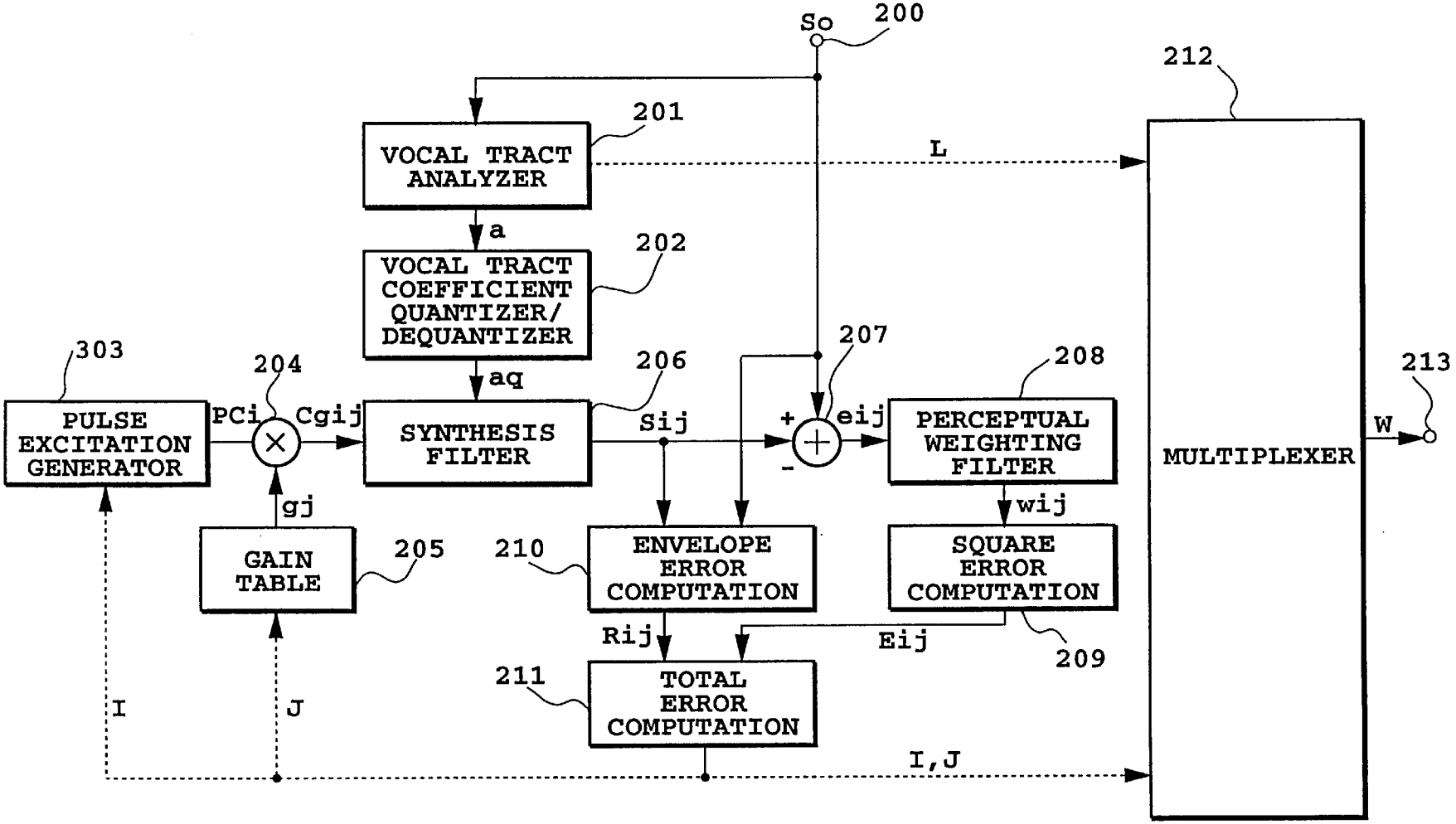
FIG. 5 is a block diagram schematically showing an alternative embodiment of the present invention and using the MPE system.

Referring to FIG. 5, an alternative embodiment of the present invention will be described. In FIG. 5, the same constituent parts as the parts shown in FIG. 2 are designated by identical reference numerals, and a detailed description thereof will not be made in order to avoid redundancy. As shown, this embodiment is identical with the previous embodiment except that it has an MPE type configuration, i.e., a pulse excitation generator 303 is substituted for the excitation codebook 203. The pulse excitation generator 303 initially reads out any one of pulse excitation vectors PCi (i=1 through N) and feeds it to the multiplier 204. The multiplier multiplies the pulse excitation vector PCi fed from the pulse excitation generator 303 by gain information gj, as stated earlier. The total error computation 211 delivers the optimal index I to the generator 303. In response, the generator 303 reads a pulse excitation vector PCi whose index matches the optimal index I. The rest of the construction and operation of this embodiment is the same as in the previous embodiment.

While the embodiments shown and described have concentrated on a forward type speech coding device, the present invention is readily applicable even to a backward type speech coding device using the AbS system. This can be done with the configuration shown in FIG. 2 only if the synthetic speech vector signal Sij output from the synthesis filter 206 is fed to the vocal tract analyzer 201 in place of the input speech vector signal So. This is also true with the configuration of FIG. 5. Further, the present invention is applicable to a VSELP (Vector Sum Excited Linear Prediction) system, LD-CELP system, CS-CELP system, or PSI (Pitch Synchronous Innovation)-CELP system, as desired.

In practice, the excitation codebook 203 should preferably be implemented as adaptive codes, statistical codes, or noise-based codes.

Further, a speech decoding device for use with the present invention may have a construction taught in any one of, e.g., Japanese patent laid-open publication Nos. 73099/1993, 130995/1994, 130998/1994, 134600/1995, and 130996/1994 if it is slightly modified.

What is claimed is:

1. A speech coding device for coding an input speech with an Analysis by Synthesis system and either of a forward type and a backward type configuration, said device comprising:

vocal tract prediction coefficient generating means for producing a vocal tract prediction coefficient from either of an input speech signal and a locally reproduced synthetic speech signal;

storage means for storing codes of an excitation codebook in one-to-one correspondence with indexes;

speech synthesizing means for producing a synthetic speech signal by using the codes stored in said storage means, and said vocal tract prediction coefficient;

comparing means for comparing said synthetic speech signal with the input speech signal to thereby generate a first error signal representative of a difference between the synthetic speech signal and the input speech signal;

perceptual weighting means for perceptually weighting said first error signal to thereby generate a perceptually weighted signal;

codebook index selecting means for selecting an optimal index for said excitation codebook out of at least said perceptually weighted signal, and providing said optimal index to said excitation codebook; and power envelope estimating means for producing a first power envelope signal from said synthetic speech signal, producing a second power envelope signal from said input speech signal, and comparing said first and second power envelope signals to thereby estimate a second error signal representative of a difference between said first and second envelope signals;

said codebook index selecting means selecting said optimal index on the basis of said second error signal and said perceptually weighted signal.

2. A device in accordance with claim 1, wherein said power envelope estimating means comprises low-pass filtering means for low-pass filtering said synthetic speech signal and said input speech signal to produce said first and second power envelope signals.

3. A device in accordance with claim 1, wherein said codebook index selecting means selects said optimal index by giving ascendancy to either of said second error signal and said perceptually weighted signal.

4. A device in accordance with claim 2, wherein said low-pass filtering means is a digital low-pass filter which has a transfer function represented by $$(1-b)/(1-b\cdot Z^{-1}),$$

where $0<b<1$.

* * * * *